US011664006B2

(12) United States Patent
Yamabe et al.

(10) Patent No.: US 11,664,006 B2
(45) Date of Patent: May 30, 2023

(54) SOUND OUTPUT DEVICE

(71) Applicant: Sony Corporation, Tokyo (JP)

(72) Inventors: Yushi Yamabe, Tokyo (JP); Naoki Shinmen, Tokyo (JP); Kenichi Oide, Tokyo (JP)

(73) Assignee: Sony Corporation, Tokyo (JP)

( * ) Notice: Subject to any disclaimer, the term of this patent is extended or adjusted under 35 U.S.C. 154(b) by 12 days.

(21) Appl. No.: 17/263,113

(22) PCT Filed: Jul. 25, 2019

(86) PCT No.: PCT/JP2019/029288
§ 371 (c)(1),
(2) Date: Jan. 25, 2021

(87) PCT Pub. No.: WO2020/026944
PCT Pub. Date: Feb. 6, 2020

(65) Prior Publication Data

US 2021/0295815 A1 Sep. 23, 2021

(30) Foreign Application Priority Data

Aug. 3, 2018 (JP) ..... JP2018-147179

(51) Int. Cl.
*G10K 11/178* (2006.01)
*H04R 1/08* (2006.01)
(Continued)

(52) U.S. Cl.
CPC ..... *G10K 11/17881* (2018.01); *H04R 1/08* (2013.01); *H04R 1/10* (2013.01);
(Continued)

(58) Field of Classification Search
CPC ..... G10K 11/17881; G10K 11/17823; G10K 11/17873; G10K 2210/1081;
(Continued)

(56) References Cited

U.S. PATENT DOCUMENTS

2003/0174846 A1 9/2003 Niederdrank
2005/0013456 A1 1/2005 Chalupper
(Continued)

FOREIGN PATENT DOCUMENTS

CN 206024053 U * 3/2017
EP 2056624 A1 5/2009
(Continued)

OTHER PUBLICATIONS

International Search Report and English translation thereof dated Sep. 3, 2019 in connection with International Application No. PCT/JP2019/029288.

*Primary Examiner* — Kile O Blair
(74) *Attorney, Agent, or Firm* — Wolf, Greenfield & Sacks, P.C.

(57) ABSTRACT

A sound output device according to an embodiment includes: an acoustic path (70) and a microphone (100*b*). The acoustic path connects a first space (54*b*) formed on a front surface of a driver unit (106) and the outside of a housing (50*b*) including the driver unit separately from a second space (55*b*) formed on a back surface of the driver unit. The microphone is disposed in the vicinity of an opening where the acoustic path is connected to the outside of the housing.

10 Claims, 16 Drawing Sheets

(51) Int. Cl.
*H04R 1/10* (2006.01)
*H04R 1/34* (2006.01)

(52) U.S. Cl.
CPC ..... *H04R 1/345* (2013.01); *G10K 2210/1081* (2013.01); *G10K 2210/3026* (2013.01); *G10K 2210/3027* (2013.01); *G10K 2210/3028* (2013.01)

(58) Field of Classification Search
CPC ... G10K 2210/3026; G10K 2210/3027; G10K 2210/3028; G10K 2210/30232; G10K 2210/30351; G10K 2210/3055
See application file for complete search history.

(56) References Cited

U.S. PATENT DOCUMENTS

| | | | |
|---|---|---|---|
| 2010/0195842 | A1 | 8/2010 | Sibbald |
| 2015/0030173 | A1 | 1/2015 | Foudhaili |
| 2016/0219361 | A1 | 7/2016 | Park |

FOREIGN PATENT DOCUMENTS

| | | | |
|---|---|---|---|
| JP | 2009-017485 | A | 1/2009 |
| JP | 2009-535655 | A | 10/2009 |
| JP | 2016-528855 | A | 9/2016 |
| WO | WO 2012/042672 | A1 | 4/2012 |

* cited by examiner

SOUND OUTPUT DEVICE

Cross-Reference To Related Applications

This application claims the benefit under 35 U.S.C. § 371 as a U.S. National Stage Entry of International Application No. PCT/JP2019/029288, filed in the Japanese Patent Office as a Receiving Office on Jul. 25, 2019, which claims priority to Japanese Patent Application Number JP2018-147179, filed in the Japanese Patent Office on Aug. 3, 2018, each of which is hereby incorporated by reference in its entirety.

FIELD

The present invention relates to a sound output device.

BACKGROUND

When earphones or headphones are worn, a need exists for reduction of sound (extraneous noise) reaching a pinna from the outside of the earphones or the headphones. Thus, a noise cancelling system that removes noise by signal processing based on an audio signal output from a microphone provided in a housing of an earphone or a headphone has been known.

CITATION LIST

Patent Literature

Patent Literature 1: Japanese Patent Application Laid-open No. 2016-086281

Patent Literature 2: Japanese Patent Application Laid-open No. 2017-120447

Patent Literature 3: National Publication of International Patent Application No. 2017-509284

SUMMARY

Technical Problem

The above noise cancelling system has room for improvement regarding system stability and noise attenuation.

The present disclosure proposes a sound output device capable of further reducing extraneous noise.

Solution to Problem

For solving the problem described above, a sound output device according to one aspect of the present disclosure has an acoustic path connecting a first space on a front surface of a driver unit and an outside of a housing including the driver unit separately from a second space on a back surface of the driver unit, and a microphone disposed in the vicinity of an opening where the acoustic path is connected to the outside of the housing.

Advantageous Effects of Invention

The present disclosure can further reduce extraneous noise. Note that the present disclosure does not necessarily have to be limited to the effect described above and may provide any effect described in the present disclosure.

DESCRIPTION OF EMBODIMENTS

Figure 1A:
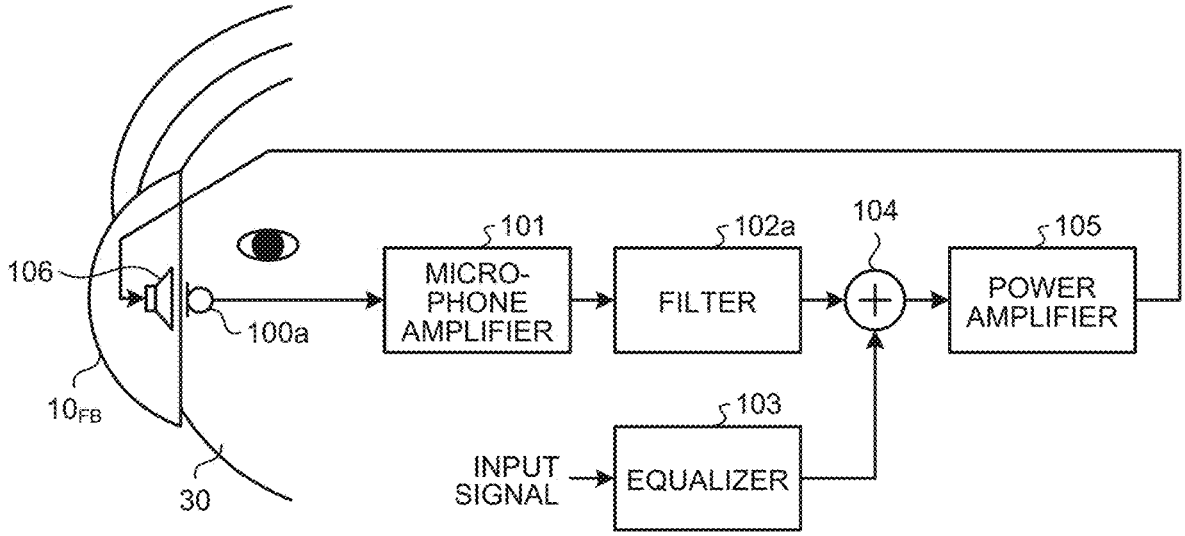
FIG. 1A is a view illustrating a configuration example of a noise cancelling system using a feedback technique.

Hereinafter, embodiments of the present disclosure will be described in detail based on the drawings. Note that the same components are denoted by the same reference numerals to omit the overlapping description in the following respective embodiments.

[Outline of the Present Disclosure]

Examples of a sound output device according to the present disclosure include an over-ear (or on-ear) type headphone (hereinafter headphone) that delivers, to a pinna from the vicinity thereof, sound generated with a diaphragm vibrating according to an audio signal in a driver unit, and a classic (or in-ear) type earphone (hereinafter earphone) that directly delivers the sound to the pinna. The sound output device is also provided with a microphone capable of collecting sound (extraneous noise) reaching from the outside of a housing including the driver unit. The sound output device corresponds to a noise cancelling system capable of reducing noise included in the sound delivered to the pinna by using an audio signal based on the noise collected by the microphone.

Before describing the present disclosure, a basic configuration of the noise cancelling system applied to the headphone and the earphone will be described in order to facilitate understanding.

(Feedback Noise Cancelling System)

Figure 1B:
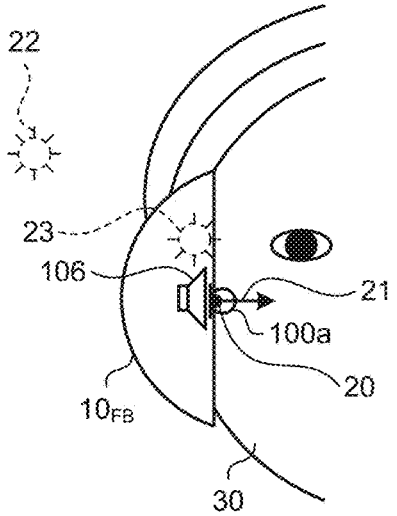
FIG. 1B is a view illustrating the configuration example of the noise cancelling system using the feedback technique.
Figure 1C:
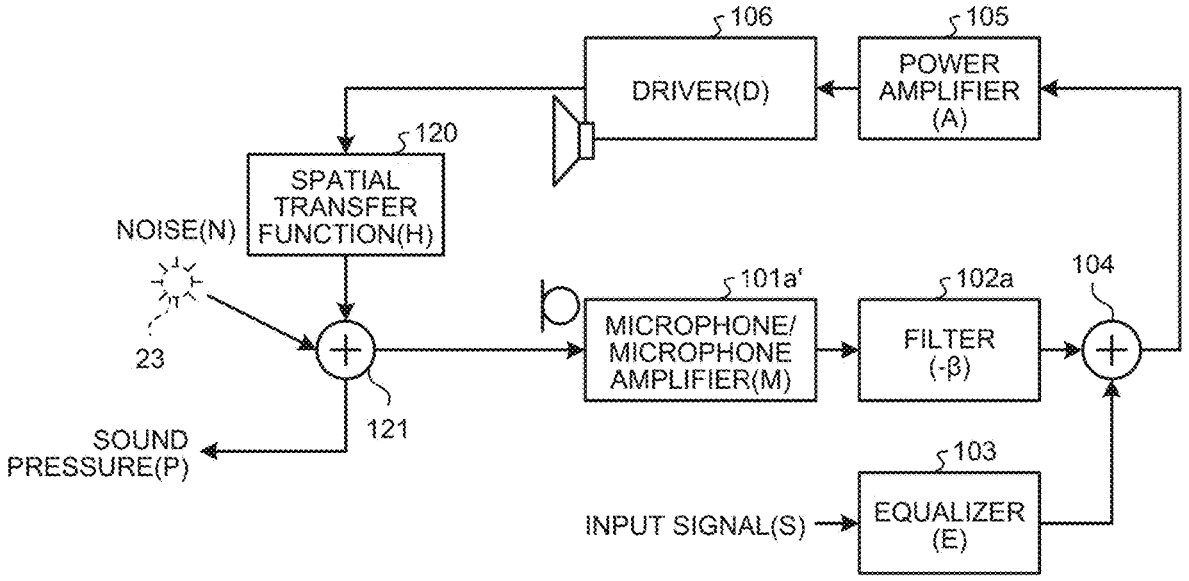
FIG. 1C is a view illustrating the configuration example of the noise cancelling system using the feedback technique.

First, a noise cancelling system using an existing feedback (hereinafter FB) technique will be described. FIGS. 1A, 1B, and 1C are views illustrating a configuration example of the feedback noise cancelling system.

FIG. 1A is a block diagram illustrating a configuration of an electrical circuit example of the FB noise cancelling system. In this example, an over-head type headphone $\mathbf{10}_{FB}$ used by being worn on a head 30 of a listener is used as the sound output device. The headphone $\mathbf{10}_{FB}$ includes a microphone 100*a* and a driver unit 106. The driver unit 106 includes, for example, a diaphragm, and generates air vibration based on an audio signal supplied thereto with the diaphragm vibrating according to the audio signal, thereby outputting sound.

In the headphone $\mathbf{10}_{FB}$, a space on the pinna side of the driver unit 106 and a space facing this space via the driver unit 106 are typically separated by a partition wall or the like. Note that a surface on the pinna side of the driver unit 106 is hereinafter referred to as a front surface and a surface facing the front surface as a back surface.

The microphone 100*a* is disposed in the front-surface space of the driver unit 106 on the inside of a housing (housing portion) of the headphone $\mathbf{10}_{FB}$ so as to collect sound within the space. In other words, the microphone 100*a* directly collects the sound within the space, i.e., sound to be guided to the pinna of the listener. An audio signal based on the sound collected by the microphone 100*a* is supplied to a filter 102*a* corresponding to the FB technique, which will be described in detail later, through a microphone amplifier 101. The audio signal filtered by the filter 102*a* is supplied to an adder 104.

Meanwhile, an input signal according to an audio signal as a sound source is supplied to the adder 104 through an equalizer 103 having a characteristic described in detail later. The adder 104 supplies an audio signal obtained by adding the output of the filter 102*a* and the output of the equalizer 103 to a power amplifier 105. The power amplifier 105 power-amplifies the supplied audio signal and supplies this signal to the driver unit 106. The driver unit 106 is driven according to the audio signal supplied from the power amplifier 105, outputting sound. The microphone 100*a* collects the sound output by the driver unit 106 and sound (extraneous noise) reaching from the outside of the headphone $\mathbf{10}_{FB}$.

FIG. 1B is a view for explaining each sound related to the headphone $\mathbf{10}_{FB}$. In FIG. 1B, a noise 22 is the extraneous noise from a noise source outside the headphone $\mathbf{10}_{FB}$. Additionally, a noise 23 is the noise 22 entering the inside of the headphone $\mathbf{10}_{FB}$. In the headphone $\mathbf{10}_{FB}$, the noise 23 and a sound pressure 21 generated based on the audio signal in the driver unit 106 reach the pinna on the head 30 on which the headphone $\mathbf{10}_{FB}$ is worn.

A control point 20 indicates a position to reduce the noise 23 in the noise cancelling system including the headphone $\mathbf{10}_{FB}$. In the case of the FB technique, the control point 20 is located at the microphone 100*a* as illustrated in FIG. 1B. Thus, typically, the microphone 100*a* is placed at a position close to the pinna, e.g., on the front surface of the diaphragm of the driver unit 106.

FIG. 1C is a view defining a transfer function for each portion of the configuration illustrated in FIG. 1A. Note that the driver unit 106 is illustrated as "driver 106" in FIG. 1C. As shown in parentheses attached to the name of each block, "M" represents the transfer function of a microphone/microphone amplifier 101*a*' combining the microphone 100*a* and the microphone amplifier 101, "−β" represents the transfer function of the filter 102*a*, "A" represents the transfer function of the power amplifier, "D" represents the transfer function of the driver 106, and "E" represents the transfer function of the equalizer 103. Additionally, "H" represents a spatial transfer function 120 that is a transfer function from the driver 106 to the microphone 100*a*. Note that each transfer function is represented by a complex number.

Moreover, "N" represents the noise 23 that is the external noise 22 illustrated in FIG. 1B entering the inside of the headphone $\mathbf{10}_{FB}$. A reason why the noise 22 is transmitted to the inside of the headphone $\mathbf{10}_{FB}$ is considered that the noise leaks as a sound pressure from, for example, a gap in an earpad portion of the headphone $\mathbf{10}_{FB}$ (an earpiece portion in the case of in-ear type) disposed in contact with skin. The reason may be also that the noise is transmitted to the inside of the housing of the headphone $\mathbf{10}_{FB}$ as a result of vibration of the housing upon receiving a sound pressure from a hole formed in communication with the outside from the front surface of the headphone $\mathbf{10}_{FB}$.

An adder 121 indicates that the output of the driver unit 106 and the noise 23 are collected by the microphone 100*a*, and corresponds to the control point 20. That is, the spatial transfer function "H" is equivalent to a transfer function from the driver unit 106 to the control point 20. Additionally, sound obtained by adding the output of a driver unit 106*b* and the noise 23 reaches the pinna as a sound pressure. The sound pressure is represented by "P". Additionally, the input signal is represented by "S".

A relation among the respective blocks in FIG. 1C can be expressed by the following equation (1) using the transfer functions.

$$P = \frac{1}{1 + ADHM\beta}N + \frac{AHD}{1 + ADHM\beta}ES \tag{1}$$

Focusing on "N" representing the noise 23 in the equation (1), it is understood that the noise 23 is attenuated to "1/(1+ADHMβ)". For the system of the equation (1) to operate stably without oscillation, a condition expressed by the following equation (2) needs to be satisfied.

$$\left|\frac{1}{1+ADHM\beta}\right| < 1 \tag{2}$$

In combination with 1<<|ADMHβ| in general, the equation (2) can be interpreted as follows.

Figure 2:
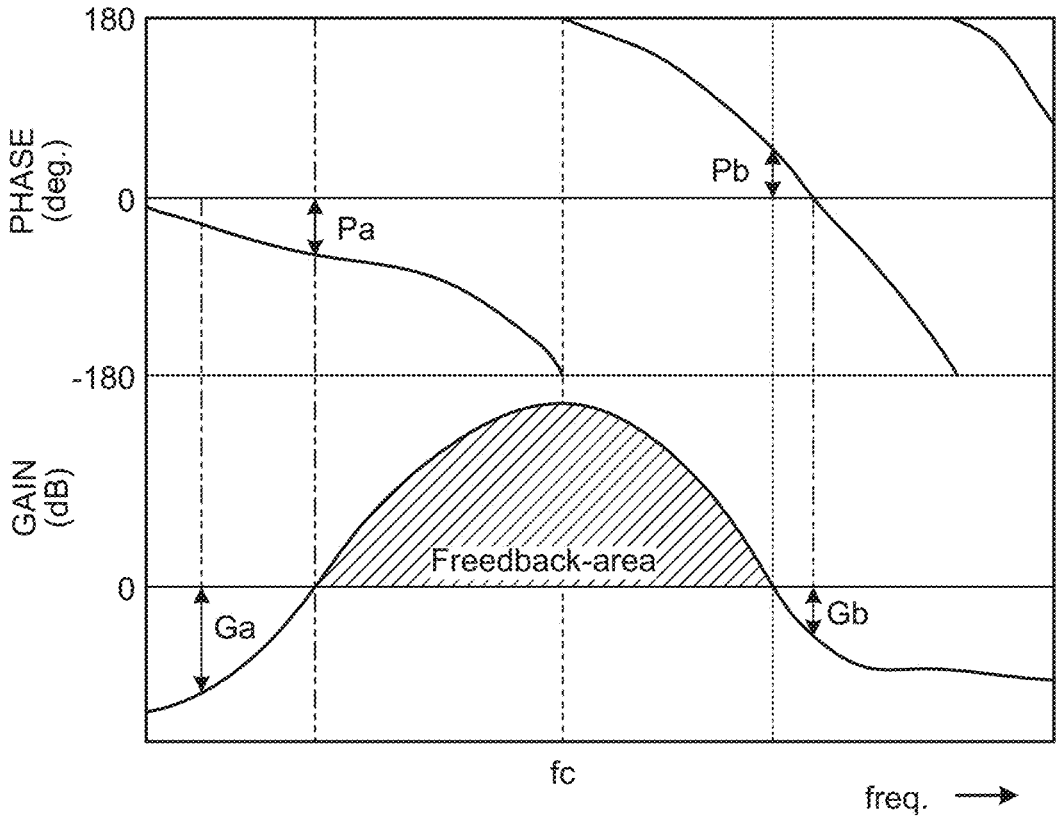
FIG. 2 is a view illustrating a bode plot.

"−ADMHβ" obtained by disconnecting one point in a loop portion related to "N" representing the noise 23 in FIG. 1C is referred to as an open loop, which has a characteristic as indicated by, for example, a bode plot of FIG. 2. When the open loop is targeted, the condition according to the above equation (2) needs to satisfy the following two conditions (1) and (2).

(1) The gain should be lower than 0 [dB] when the phase passes a point of 0 [deg].

(2) The phase should not include a point of 0 [deg] when the gain is 0 [dB] or higher.

When the above conditions (1) and (2) are not satisfied, positive feedback is effected in the loop to cause oscillation (howling). In FIG. 2, margins Pa and Pb represent phase margins, and margins Ga and Gb represent gain margins. When the margins Pa and Pb and the margins Ga and Gb are small, the risk of oscillation is increased depending on, for example, individual differences in face shape or variations in wearing state of the headphone $\mathbf{10}_{FB}$.

Next, reproduction of sound according to the input signal from the headphone $\mathbf{10}_{FB}$ will be described in addition to the above-described function of reducing the noise reaching from the outside. The input signal "S" in FIG. 1C is an audio signal based on original sound to be reproduced by the driver unit 106 of the headphone $\mathbf{10}_{FB}$, and includes an audio signal such as a music signal, sound of a microphone outside the housing (a use example as a hearing aid function), and a speech signal through communication (a use example as a headset).

Focusing on the input signal "S" in the above equation (1), the sound pressure "P" is expressed by the following equation (4) by setting the transfer function "E" of the equalizer 103 as in the following equation (3).

$$E=(1+\mathrm{ADHM}\beta) \tag{3}$$

$$P=\frac{1}{1+ADHM\beta}N+AHDS \tag{4}$$

When the microphone 100*a* is placed very close to the pinna, the transfer function "H" can be considered as a transfer function from the driver unit 106 to the microphone 100*a* (pinna). Here, the transfer functions "A" and "D" are the transfer functions of the power amplifier 105 and the driver unit 106, respectively. Thus, it is understood that a characteristic similar to that of a headphone with no noise reducing function is obtained. Note that the equalizer 103 at this time has a substantially inverse characteristic from the open loop characteristic as viewed on a frequency axis.

(Feed-Forward Noise Cancelling System)

Figure 3A:
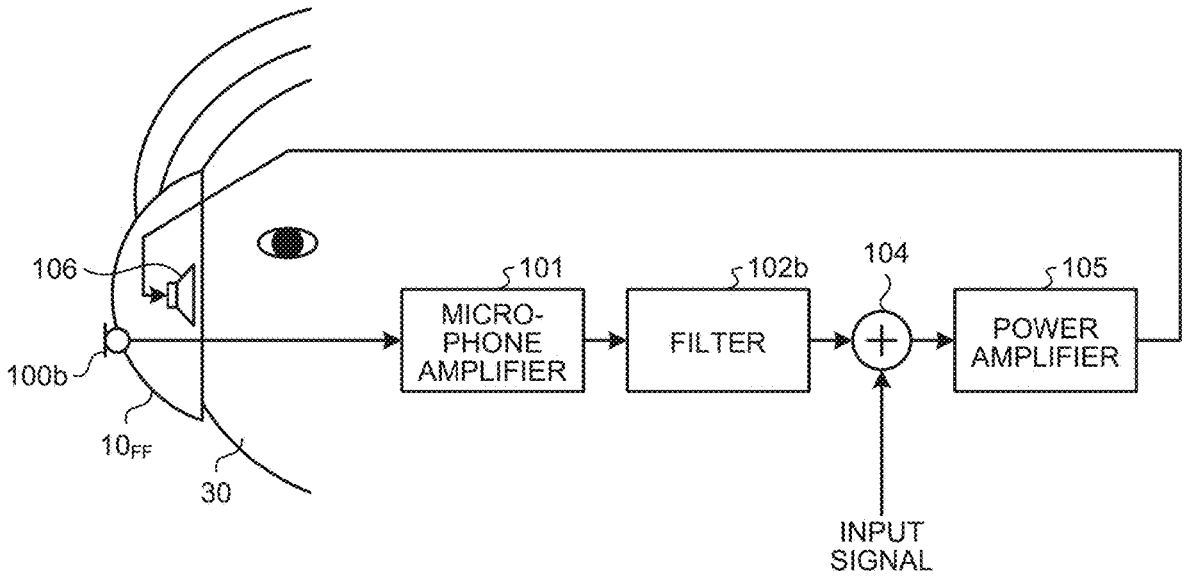
FIG. 3A is a view illustrating a configuration example of a noise cancelling system using an FF technique.
Figure 3B:
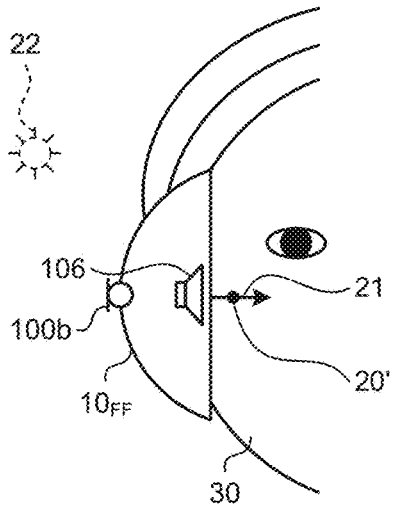
FIG. 3B is a view illustrating the configuration example of the noise cancelling system using the FF technique.
Figure 3C:
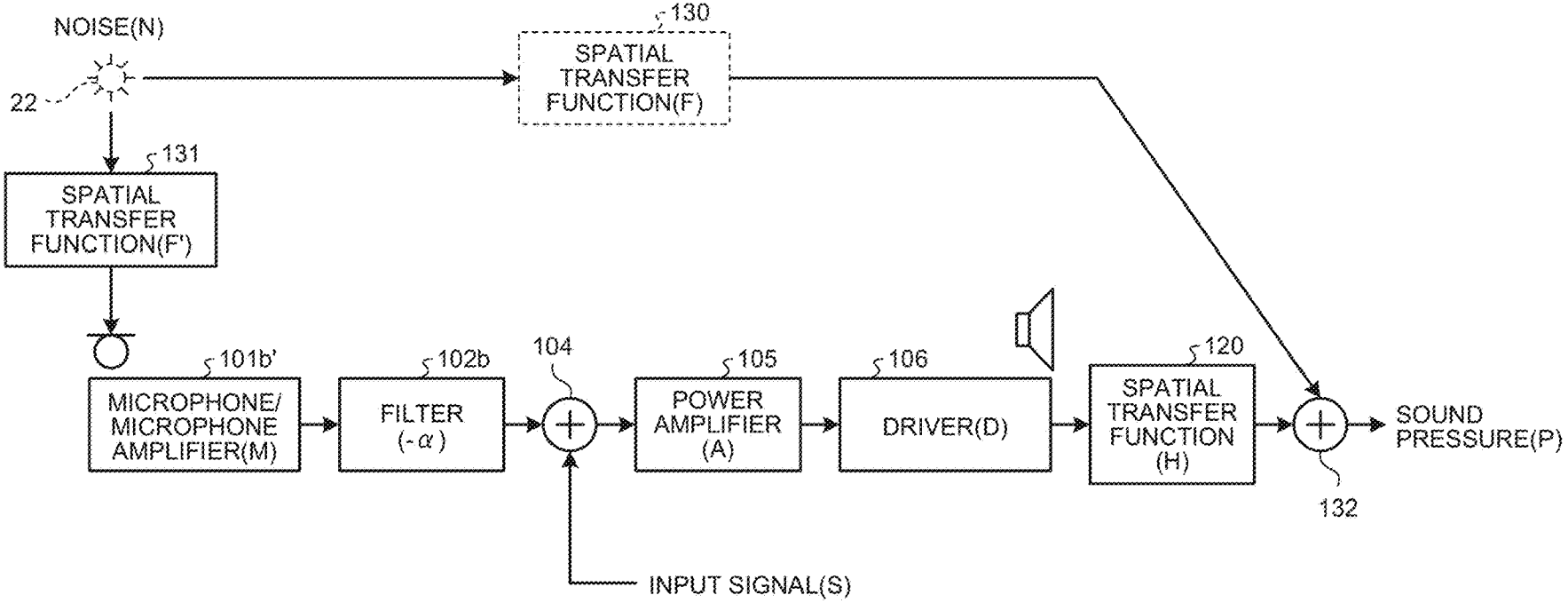
FIG. 3C is a view illustrating the configuration example of the noise cancelling system using the FF technique.

Next, a noise cancelling system using an existing feed-forward (hereinafter FF) technique will be described. FIGS. 3A, 3B, and 3C are views illustrating a configuration example of the FF noise cancelling system.

FIG. 3A is a block diagram illustrating a configuration of an electrical circuit example of the FF noise cancelling system. In the configuration illustrated in FIG. 3A, the equalizer 103 is omitted and a filter 102*b* having a characteristic corresponding to the FF technique is provided instead of the filter 102*a* as compared with the above configuration illustrated in FIG. 1A. The input signal is directly input into the adder 104. Additionally, in a headphone $\mathbf{10}_{FF}$, a microphone 100*b* for collecting extraneous noise is placed on a surface of the housing of the headphone $\mathbf{10}_{FF}$. An omni-directional microphone is used as the microphone 100*b*.

FIG. 3B is a view for explaining each sound related to the headphone $\mathbf{10}_{FF}$. In FIG. 3B, the microphone 100*b* collects the noise 22 from the noise source outside the headphone $\mathbf{10}_{FF}$. Moreover, in the example of FIG. 3B, a control point 20' is placed at a position close to the pinna on the front surface of the driver unit 106 similarly to the headphone $\mathbf{10}_{FB}$ illustrated in FIG. 1B. In the FF technique, the control point 20' can be set at any pinna position of the listener.

FIG. 3C is a view defining a transfer function for each portion of the configuration illustrated in FIG. 3A. Note that the driver unit 106 is illustrated as "driver 106" in FIG. 3C. In this example, "M" represents the transfer function of a microphone/microphone amplifier 101*b*' combining the microphone 100*b* and the microphone amplifier 101. Additionally, "−α" represents the transfer function of the filter 102*b*, and "H" represents the spatial transfer function 120 from the driver unit 106 to an adder 132 corresponding to the control point 20. Moreover, "F" represents a spatial transfer function 130 of the noise 22 as the extraneous noise reaching the control point 20 (the adder 132) through the housing of the headphone $\mathbf{10}_{FF}$, and "F'" represents a spatial transfer function 131 of the noise 22 reaching the microphone 100*b*.

A relation among the respective blocks in FIG. 3C can be expressed by the following equation (5) using the transfer functions.

$$P=-F'\mathrm{ADHM}\alpha N+FN+\mathrm{ADHS} \tag{5}$$

Here, the spatial transfer function "F" (the spatial transfer function 130) is expressed as in the following equation (6) in consideration of an ideal state. In this case, the above equation (5) can be expressed as in the following equation (7).

$$F=F'\mathrm{ADHM}\alpha \tag{6}$$

$$P=\mathrm{ADHS} \tag{7}$$

According to the equation (7), the input signal "S" is left in the sound pressure "P", which does not include the noise "N". Thus, it is understood that the noise is cancelled, and sound equivalent to that in a normal headphone operation (i.e., an operation in a state in which the external noise 22 is not present) can be listened to.

Unfortunately, it is practically difficult to configure the perfect filter 102*b* having the transfer function "−α" that perfectly satisfies the equation (6). Especially in a mid-to-high frequency range, the characteristic changes due to large individual differences in wearing state and ear shape among listeners, and depending on the position of the source of the noise 22, and the position of the microphone 100*b*. Thus, in the mid-to-high frequency range, the active noise reducing process according to FIG. 3C is not normally performed, but passive sound isolation is often performed by, for example, increasing sealing performance against external noise in the housing of the headphone $\mathbf{10}_{FF}$.

Note that the equation (6) means that the spatial transfer function "F'" (the spatial transfer function 131) from the noise source of the noise 22 to the pinna position is imitated in the electrical circuit including the transfer function "$-\alpha$" of the filter 102*b*.

As described above, in the FF technique, the control point 20' can be set at any pinna position of the listener. Meanwhile, the transfer function "$-\alpha$" of the filter 102*b* is typically fixed, and it is necessary to design the filter 102*b* in a limited manner aiming at some target characteristic in design stage. In this case, there is a possibility that a sufficient noise cancelling effect cannot be obtained due to the pinna shape of each listener being different from that expected at the time of design, or that a noise component is added in non-reverse phase, resulting in a phenomenon such as occurrence of unusual sound.

Based on the above description, while the FF technique typically achieves a low risk of oscillation and high stability, it is difficult to achieve sufficient noise attenuation. Meanwhile, the FB technique, which is expected to achieve high attenuation, is inferior to the FF technique regarding the stability of the system.

A noise cancelling system using a method of adaptive signal processing has also been proposed. The noise cancelling system using the method of adaptive signal processing is typically provided with a microphone on, for example, both of the inside and the outside of the headphone housing. The microphone provided on the inside of the headphone is used in analyzing an error signal intended for cancellation with a filtered component, and generating a new adaptive filter by updating its coefficients. Basically, noise outside the headphone housing is digitally filtered and the obtained sound is reproduced in the driver unit. Thus, it can be roughly said that the noise cancelling system using the method of adaptive signal processing uses the FF technique. Unfortunately, the noise cancelling system using the method of adaptive signal processing has a problem of system stability and a cost-effectiveness problem due to a large processing scale.

Therefore, the present disclosure intends to improve the characteristics by the noise cancellation using the FF technique.

First Embodiment

Figure 4A:
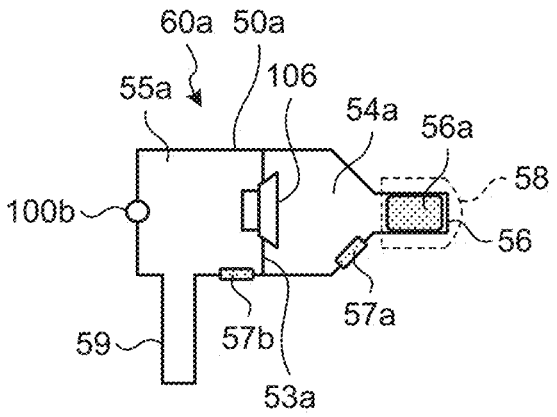
FIG. 4A is a view illustrating a configuration of an earphone example according to an existing technique.
Figure 4B:
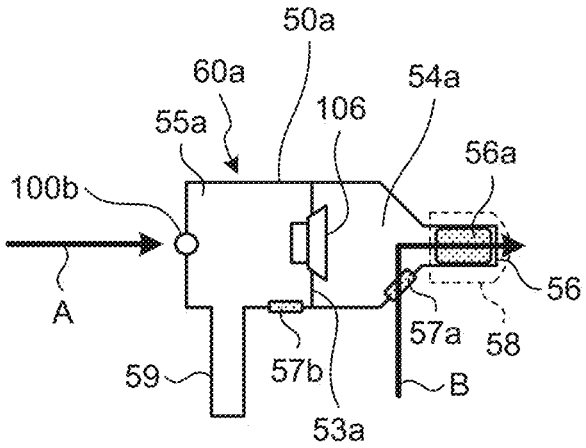
FIG. 4B is a view illustrating the configuration of the earphone example according to the existing technique.
Figure 4C:
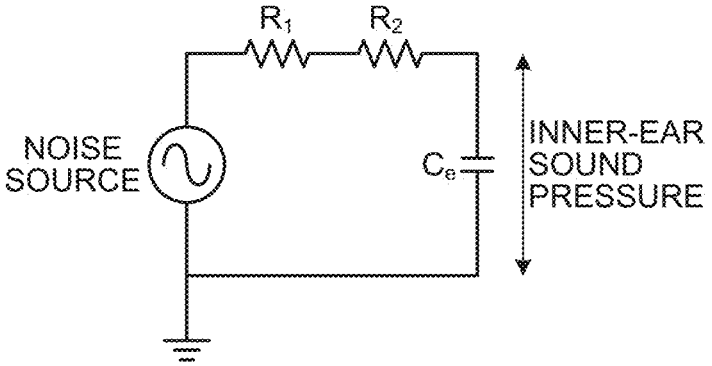
FIG. 4C is a view illustrating the configuration of the earphone example according to the existing technique.

Next, a first embodiment will be described. In the first embodiment, the sound output device according to the present disclosure will be described as an in-ear type earphone (hereinafter referred to as earphone). First, a configuration of an earphone performing the noise cancellation using the FF technique, according to an existing technique, will be described in contrast to the earphone according to the present disclosure. FIGS. 4A, 4B, and 4C are views illustrating a configuration of an earphone example according to the existing technique.

In FIG. 4A, an earphone 60*a* according to the existing technique includes a sound output port 56 that guides sound output from the driver unit 106 to the pinna, and a cylindrical portion 59 to which a wire for supplying an audio signal to the driver unit 106 is connected. For example, an opening of the sound output port 56 has a smaller area than the front surface of the driver unit 106. The driver unit 106 is a dynamic-type driver unit including a voice coil, a magnet, and the diaphragm and outputting sound with the diaphragm vibrating according to the audio signal input into the voice coil.

A partition wall 53*a* for separating the front surface and the back surface of the driver unit 106 is disposed within a housing 50*a* of the earphone 60*a*. The inside of the housing 50*a* of the earphone 60*a* is divided into a space 54*a* (first space) on the front surface side of the driver unit 106 and a space 55*a* (second space) on the back surface side thereof by the driver unit 106 and the partition wall 53*a*.

Here, the front surface of the driver unit 106 is a surface of the driver unit 106 on a side spatially directly connected to the sound output port 56. The back surface of the driver unit 106 is a surface of the driver unit 106 on an opposite side to the front surface.

As illustrated in FIG. 4A, a vent hole 57*a* connecting the front-surface space 54*a* and the outside, and a vent hole 57*b* connecting the back-surface space 55*a* and the outside are disposed at predetermined positions of the housing 50*a*. The vent hole 57*a* is provided for lessening a pressure load on an eardrum, reducing individual differences in output sound, or the like when the earphone 60*a* is worn on the pinna of the listener to output sound. In the example of FIG. 4A, the vent hole 57*a* is disposed in a wall of the housing 50*a* constituting the front-surface space 54*a*. Additionally, the vent hole 57*b* is provided for lessening a load on the diaphragm of the driver unit 106 in, for example, outputting sound.

Actually, a ventilation resistance body 56*a* made of, for example, compressed urethane or non-woven fabric is provided within the sound output port 56. Moreover, an earpiece 58 made of urethane or silicone rubber is typically attached to the sound output port 56 to adjust a size for the pinna and improve adhesion to the pinna.

The microphone 100*b* for sound collection using the FF technique is also disposed on, for example, the surface of the housing 50*a* of the earphone 60*a*.

FIG. 4B is a view illustrating an action example of the noise 22 for the earphone 60*a* having the configuration in FIG. 4A. The noise 22 is collected by the microphone 100*b* as indicated by a path A. The noise 22 is also input into the front-surface space 54*a* from the vent hole 57*a* and guided to the pinna through the sound output port 56 from the front-surface space 54*a* as indicated by a path B.

FIG. 4C illustrates an example of an acoustic equivalent circuit of a sound isolation path for performing sound isolation of the noise 22 based on the structure in FIG. 4B. In FIG. 4C, a capacitor $C_e$ is an ear canal volume of the pinna where the earphone 60*a* is worn, and a sound pressure supplied to the capacitor $C_e$ is an inner-ear sound pressure. The noise 22 from the noise source is supplied to the capacitor $C_e$ through acoustic resistance $R_1$ by the vent hole 57*a* and acoustic resistance $R_2$ by the ventilation resistance body 56*a*.

Figure 5A:
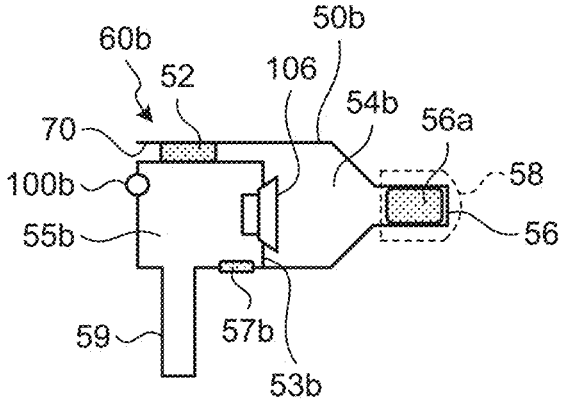
FIG. 5A is a view illustrating a configuration of an earphone example according to a first embodiment.
Figure 5B:
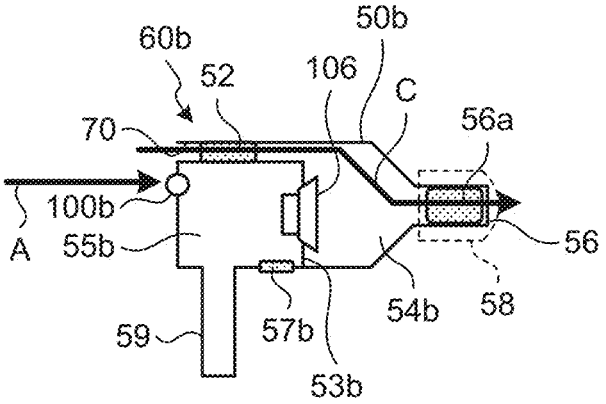
FIG. 5B is a view illustrating the configuration of the earphone example according to the first embodiment.
Figure 5C:
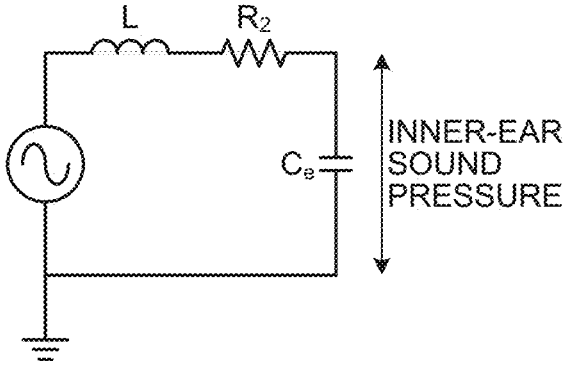
FIG. 5C is a view illustrating the configuration of the earphone example according to the first embodiment.

FIGS. 5A, 5B, and 5C are views illustrating a configuration of an earphone example according to the first embodiment. In an earphone 60*b* according to the first embodiment illustrated in FIG. 5A, a partition wall 53*b* separates the front surface and the back surface of the driver unit 106 to form a front-surface space 54*b* and a back-surface space 55*b*.

Here, in the earphone 60*b* according to the first embodiment, the front-surface space 54*b* and the outside of a housing 50*b* are connected by an acoustic path 70 that is separated from the back-surface space 55*b*. The noise 22 is collected by the microphone 100*b* as indicated by the path A. The noise 22 is also input from a connection portion of the acoustic path 70 on the surface of the housing 50*b* of the earphone 60*b* as indicated by a path C. The connection portion is an opening formed in the surface of the housing 50*b*. The noise 22 is input into the front-surface space 54*a* through the acoustic path 70 and guided to the pinna through the sound output port 56 from the front-surface space 54*a*. For example, an opening of the sound output port 56 has a smaller area than the front surface of the driver unit 106.

For example, a cylinder that is opened at an end connected to the partition wall 53*b* and an end connected to the outside of the housing 50*b* can be used as the acoustic path 70. Additionally, in the first embodiment, the acoustic path 70 is disposed at a position not in contact with the driver unit 106. A ventilation resistance body 52 made of, for example, urethane foam or non-woven fabric is preferably provided within the acoustic path 70 or around the connection portion (opening). The connection portion (opening) may be also covered with a lid made of metal or synthetic resin where a plurality of holes are formed.

Note that the acoustic path 70 may have a shape other than the cylindrical shape, such as a shape whose cross section has an oval, rectangular, triangular, or pentagonal or more polygonal shape. Additionally, the acoustic path 70 is not limited to the shape directly connecting the partition wall 53*b* and a connection position with the outside of the housing 50*b* and may have any shape that is topologically equivalent.

FIG. 5C illustrates an example of an acoustic equivalent circuit of a sound isolation path for performing sound isolation of the noise 22, according to the first embodiment based on the structure in FIG. 5B. In FIG. 5C, the noise 22 from the noise source is supplied to the capacitor $C_e$ through inductance L by the acoustic path 70 and the acoustic resistance $R_2$ by the ventilation resistance body 56*a*.

When FIG. 5C and FIG. 4C described above are compared, the inductance L by the acoustic path 70 is connected in the equivalent circuit in FIG. 5C instead of the acoustic resistance $R_1$ by the vent hole 57*a* in the equivalent circuit in FIG. 4C. Meanwhile, the acoustic resistance $R_2$ by the ventilation resistance body 56*a* is considered to be common in FIG. 4C and FIG. 5C. In the equivalent circuit in FIG. 5C, a mid-to-high-frequency component is attenuated by the inductance L. Thus, a high passive attenuation effect can be expected.

In the earphone 60*b* according to the first embodiment, the microphone 100*b* for noise collection using the FF technique is further disposed in the vicinity of the connection portion (opening) where the acoustic path 70 is connected to the outside of the housing 50*b* of the earphone 60*b* on the surface of the housing 50*b*. The external noise 22 collected by the microphone 100*b* can be thereby collected in a state close to the noise 22 reaching the pinna through the acoustic path 70. Consequently, the noise cancelling effect according to the FF technique can be further improved.

In this case, examples of the vicinity include a state in which an end of a sound collection surface of the microphone 100*b* and an end of the connection portion (opening) of the acoustic path 70 on the surface of the housing 50*b* of the earphone 60*b* are in contact with each other. In addition to this state, the vicinity can include a state in which the end of the sound collection surface of the microphone 100*b* and the end of the connection portion (opening) are distant from each other by about several millimeters. For example, it is assumed that the sound collection surface of the microphone 100*b* has a diameter of 4 mm, and the surface of the housing 50*b* of the earphone 60*b* where the microphone 100*b* and the connection portion (opening) of the acoustic path 70 are provided has a diameter of 10 mm. In this case, when the microphone 100*b* and the connection portion (opening) of the acoustic path 70 are placed on this surface, the microphone 100*b* can be considered to be in the vicinity of the connection portion (opening) of the acoustic path 70.

Figure 5D:
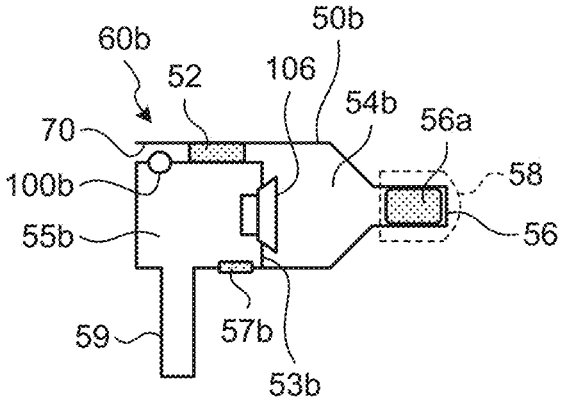
FIG. 5D is a view illustrating a configuration of another earphone example according to the first embodiment.

The microphone 100*b* may be also located in the acoustic path 70 as illustrated in FIG. 5D. In this case, the microphone 100*b* that is placed at a position distant from the connection portion (opening) of the acoustic path 70 by about several millimeters can be considered to be in the vicinity of the connection portion (opening) of the acoustic path 70.

When the microphone 100*b* is located in the acoustic path 70, the microphone 100*b* that is located on the inside of the connection portion (opening) of the acoustic path 70 and closer to the connection portion (opening) than the ventilation resistance body 52 can be considered to be in the vicinity of the connection portion (opening) of the acoustic path 70.

Moreover, when the microphone 100*b* is located in the acoustic path 70, the microphone 100*b* that satisfies a condition as described below can be also considered to be in the vicinity of the connection portion (opening) of the acoustic path 70.

Figure 5E:
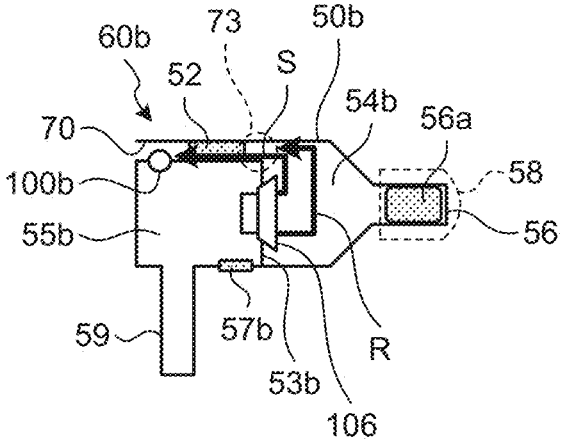
FIG. 5E is a view illustrating the configuration of the earphone example according to the first embodiment.

That is, referring to FIG. 5E, "Dx" represents the transfer function of sound output from the driver unit 106, reaching a portion 73 connected to the acoustic path 70 through the front-surface space 54*b* from the driver unit 106 as indicated by a path R. Additionally, "Dy" represents the transfer function of the sound reaching the microphone 100*b* through the front-surface space 54*b* and the acoustic path 70 from the driver unit 106 as indicated by a path S. In this case, when the microphone 100*b* is placed at a position where |Dx|/|Dy| that is a ratio of absolute values of Dx and Dy is higher than about 10 [dB], the microphone 100*b* can be considered to be in the vicinity of the connection portion (opening) of the acoustic path 70.

Here, when the microphone 100*b* is mounted at a predetermined position with respect to the connection portion (opening) of the acoustic path 70 on the surface of the housing 50*b* of the earphone 60*b*, the microphone 100*b* needs to be located at a position not causing howling in the earphone 60*b*. Such a position can be obtained by, for example, experiments.

The vicinity may also include a position of the microphone 100*b* where a difference between a characteristic of sound collected by the microphone 100*b* and a characteristic of sound at the connection portion (opening) of the acoustic path 70 on the surface of the housing 50*b* is equal to or less than a predetermined value. In this case, a measurable value in the transfer function, such as a frequency characteristic, can be used as the characteristic.

Note that a direction of the connection portion (opening) of the acoustic path 70 and a direction perpendicular to the sound collection surface of the microphone 100*b* are preferably substantially equal to each other.

Figure 6:
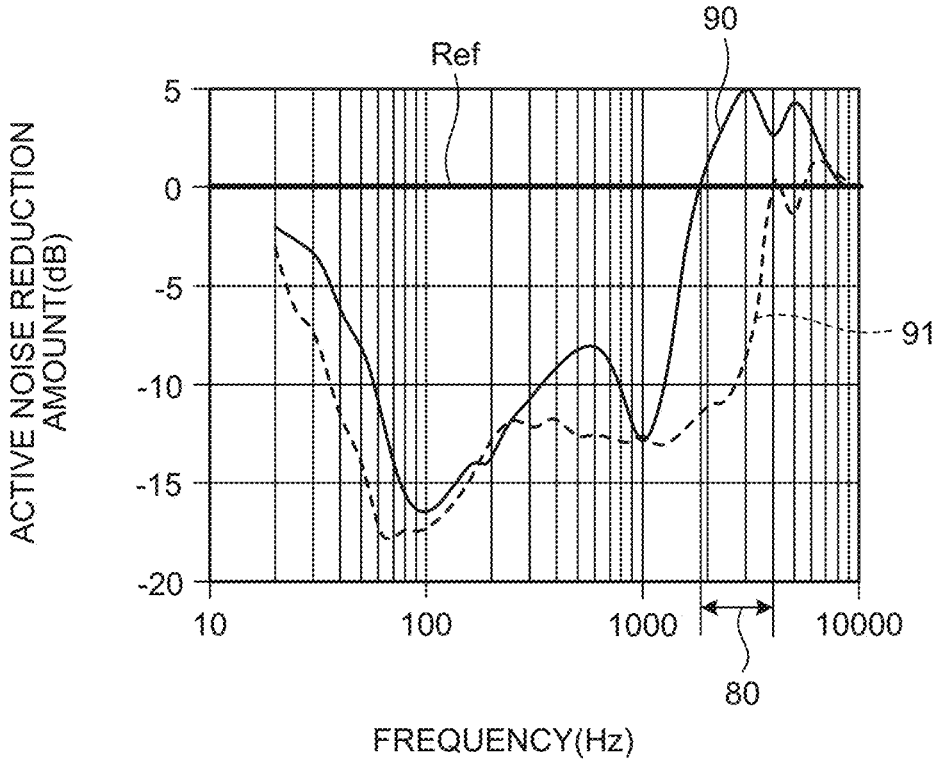
FIG. 6 is a view for explaining an effect according to the first embodiment.

FIG. 6 is a view for explaining the effect according to the first embodiment. In FIG. 6, the horizontal axis represents a frequency [Hz] displayed on a logarithmic scale. The vertical axis represents an active noise reduction amount [dB]. The active noise reduction amount is a noise reduction amount obtained when the noise cancelling system in FIGS. 3A to 3C is operated based on noise reduction amounts in the earphones 60*a* and 60*b* obtained in passive sound isolation, i.e., when the noise cancelling system is not operated, as a reference value (Ref).

In FIG. 6, a characteristic line 90 shows a characteristic of the earphone 60*a* according to the existing technique, described using FIGS. 4A to 4C. Additionally, a characteristic line 91 shows a characteristic of the earphone 60*b* according to the first embodiment, described using FIGS. 5A to 5C. When the characteristic lines 90 and 91 in FIG. 6 are compared, it is understood that the characteristic line 91 has a larger active noise reduction amount than the characteristic line 90. Especially in a frequency band 80 from approximately 2 [kHz] to approximately 4 [kHz], a reduction effect of 10 [dB] or more can be observed in the active noise reduction amount indicated by the characteristic line 91 with respect to the active noise reduction amount indicated by the characteristic line 90.

As described above, disposing the microphone 100*b* in the vicinity of the connection portion (opening) of the acoustic path 70 on the surface of the housing 50*b* allows the noise reaching the pinna from the outside to be further reduced in the FF noise cancelling system.

First Modification of the First Embodiment

Figure 7A:
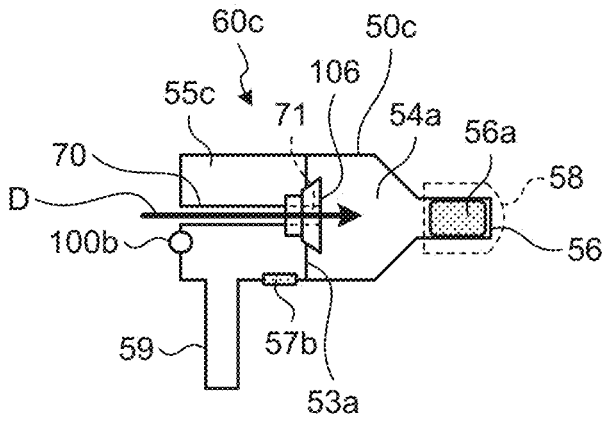
FIG. 7A is a view illustrating a configuration of an earphone example according to a first modification of the first embodiment.

Next, a first modification of the first embodiment will be described. An earphone according to the first modification of the first embodiment will be described using FIGS. 7A and 7B. FIG. 7A is a view illustrating a configuration of an example of an earphone 60*c* according to the first modification of the first embodiment.

As illustrated in FIG. 7A, the earphone 60*c* according to the first modification of the first embodiment is provided with a vent hole 71 in, for example, the center of the driver unit 106 so as to penetrate the front surface and the back surface of the driver unit 106. The acoustic path 70 is connected to the vent hole 71 or configured including the vent hole 71 to connect the front-surface space 54*a* and the outside of a housing 50*c* of the earphone 60*c* separately from a back-surface space 55*c* that is separated from the front-surface space 54*a* by the partition wall 53*a*.

Figure 7B:
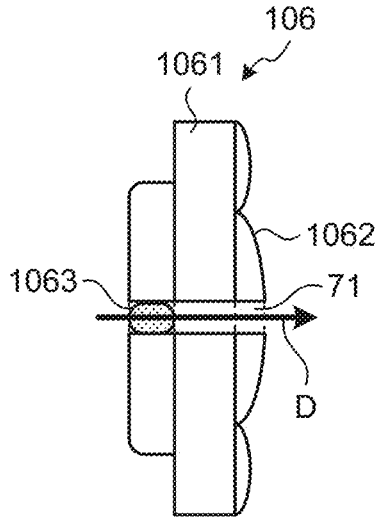
FIG. 7B is a view schematically illustrating a structure of a driver unit example.

FIG. 7B is a view schematically illustrating a structure of an example of the driver unit 106. In the example of FIG. 7B, the driver unit 106 includes a frame 1061, a diaphragm 1062, and a ventilation resistance body 1063. The frame 1061 includes, for example, a magnet and a voice coil connected to the diaphragm 1062. The diaphragm 1062 vibrates according to the audio signal input into the voice coil to output sound. Here, a doughnut-shaped magnet having a hollow center is used as the magnet so as to form a hole in the center of the diaphragm 1062. The vent hole 71 can be thereby formed penetrating the front surface and the back surface of the driver unit 106.

The microphone 100*b* is disposed in the vicinity of the connection portion (opening) where the acoustic path 70 is connected to the surface of the housing 50*c* of the earphone 60*c* in a similar manner to the above first embodiment. Configuring the earphone 60*c* as described above also allows the noise reaching the pinna from the outside to be further reduced in the FF noise cancelling system in a similar manner to the above first embodiment.

Second Modification of the First Embodiment

Figure 8:
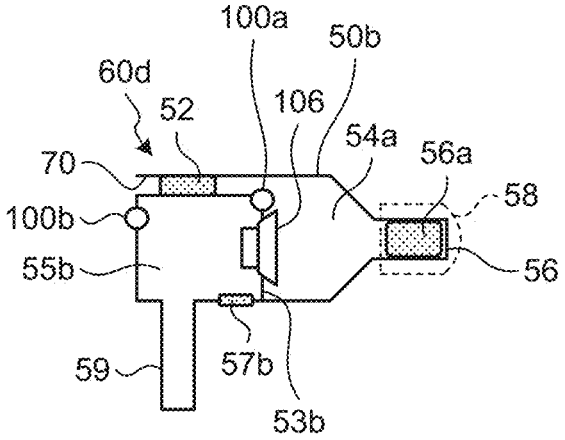
FIG. 8 is a view illustrating a configuration of an earphone example according to a second modification of the first embodiment.

Next, a second modification of the first embodiment will be described. FIG. 8 is a view illustrating a configuration of an earphone example according to the second modification of the first embodiment. An earphone 60*d* according to the second modification of the first embodiment illustrated in FIG. 8 is provided by adding the microphone 100*a* for the FB noise cancelling system to the front-surface space 54*b* in, for example, the earphone 60*b* according to the first embodiment described using FIG. 5A.

In this configuration, the electrical circuit of the noise cancelling system includes the microphone amplifier, the filter 102*a*, and the equalizer 103 in FIG. 1A, and the microphone amplifier 101 and the filter 102*b* in FIG. 3A.

The second modification of the first embodiment enables improvement in stability while reducing the gain and decreasing the noise attenuation in the signal processing circuit using the FB technique, and further enables noise removal using the FF technique. As a result, the noise attenuation in the entire system can be increased, and the system can be stably operated.

While it has been described that the microphone 100*a* for the FB noise cancelling system is added to the earphone 60*b* according to the first embodiment, the configuration is not limited to this example. For example, the microphone 100*a* may be also added to the front-surface space 54*a* (see FIG. 7A) of the earphone 60*c* according to the first modification of the first embodiment. The same applies to a configuration in FIG. 9 described below.

Third Modification of the First Embodiment

Figure 9:
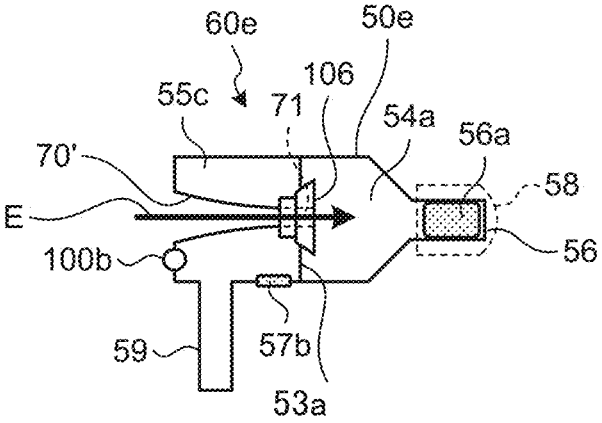
FIG. 9 is a view illustrating a configuration of an earphone example according to a third modification of the first embodiment.

Next, a third modification of the first embodiment will be described. FIG. 9 is a view illustrating a configuration of an earphone example according to the third modification of the first embodiment. Note that FIG. 9 shows an example in which the configuration according to the third modification of the first embodiment is applied to the configuration of the earphone 60*c* according to the first modification of the first embodiment described using FIG. 7A.

While it has been described that the acoustic path 70 has a cylindrical shape in the first embodiment and the first and second modifications of the first embodiment described above, the shape is not limited to this example. An earphone 60*e* according to the third modification of the first embodiment illustrated in FIG. 9 includes an acoustic path 70' that connects the front-surface space 54*a* of the driver unit 106 and the surface of a housing 50*e* of the earphone 60*e*. The acoustic path 70' is shaped such that the opening at the connection portion where the acoustic path 70' is connected to the surface of the housing 50*e* has a larger area than an opening at a connection portion where the acoustic path 70' is connected to the front-surface space 54*a*.

To be more specific, the acoustic path 70' has a so-called trumpet shape in which its diameter is increased nonlinearly from the driver unit 106 toward the surface of the housing 50*e*. In other words, a longitudinal cross section of the acoustic path 70' according to the third modification of the first embodiment is curved symmetrically to the longitudinal center. The acoustic path 70' is not limited to this shape, and the longitudinal cross section thereof may be also curved asymmetrically to the longitudinal center.

The microphone 100*b* is disposed in the vicinity of the connection portion (opening) where the acoustic path 70' is connected to the surface of the housing 50*e* of the earphone 60*e* in a similar manner to the above first embodiment. Configuring the earphone 60*e* as described above also allows the noise reaching the pinna from the outside to be further reduced in the FF noise cancelling system in a similar manner to the above first embodiment.

Additionally, in the third modification of the first embodiment, the acoustic path 70' is shaped such that the opening in the surface of the housing 50*e* has a larger area than the opening connected to the front-surface space 54*a* as described above. This makes directivity of the acoustic path 70' against the noise 22 input thereinto close to that of the omni-directional microphone 100*b*. Thus, improvement in the noise reducing effect according to the FF technique can be expected.

Note that the acoustic path 70' according to the third modification of the first embodiment can be similarly applied to the earphone 60*b* according to the first embodiment and the earphone 60*d* according to the third modification of the first embodiment described above.

Second Embodiment

Figure 10:
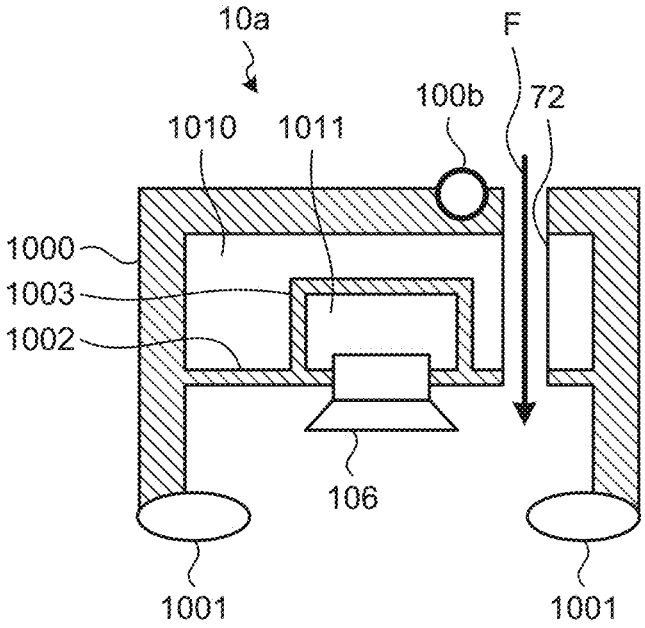
FIG. 10 is a view illustrating a configuration of a headphone example according to a second embodiment.

Next, a second embodiment will be described. The second embodiment is an example in which the present disclosure is applied to an over-ear (or on-ear) type headphone. FIG. 10 is a view illustrating a configuration of a headphone example according to the second embodiment. In a headphone 10*a* according to the second embodiment illustrated in FIG. 10, a housing 1000 is divided into the front surface and the back surface of the driver unit 106 by a partition wall 1002, and the front surface side of the driver unit 106 has an open structure. On the front surface side, an end of the housing 1000 covers the pinna on the head 30 of the listener via an earpad 1001 made of urethane or the like. The front surface of the driver unit 106, a portion of the housing 1000, the earpad 1001, and the head 30 of the listener form the front-surface space (first space) of the driver unit 106.

Additionally, in the example of FIG. 10, a first back-surface space 1010 (second space) is formed by the partition wall 1002 on the back surface side of the driver unit 106 in the housing 1000 of the headphone 10*a*. Moreover, in the example of FIG. 10, a partition wall 1003 is disposed in the first back-surface space 1010 so as to form a second back-surface space 1011 (third space) including a back-surface portion of the driver unit 106.

In the headphone 10*a* according to the second embodiment, the front-surface space of the driver unit 106 and the outside of the housing 1000 are connected by an acoustic path 72 that is separated from the first back-surface space 1010 through the first back-surface space 1010. The connection portion (opening) may be covered with a lid made of metal or synthetic resin where a plurality of holes are formed. For example, a cylinder that is opened at an end connected to the partition wall 1002 and an end connected to the outside of the housing 1000 can be used as the acoustic path 72 similarly to the acoustic path 70 in the above first embodiment. Additionally, in the second embodiment, the acoustic path 72 is disposed at a position not in contact with the driver unit 106. A ventilation resistance body made of, for example, urethane foam or non-woven fabric is preferably provided within the acoustic path 72.

The microphone 100*b* for noise collection using the FF technique is disposed in the vicinity of the connection portion (opening) where the acoustic path 72 is connected to the housing 1000 of the headphone 10*a* on the surface of the housing 1000 of the headphone 10*a*. The external noise 22 collected by the microphone 100*b* can be thereby collected in a state close to the noise 22 reaching the pinna through the acoustic path 72 (see a path F in FIG. 10). Consequently, the noise cancelling effect according to the FF technique can be further improved.

Note that the definition of the vicinity described in the first embodiment can be applied to the vicinity in this case. Here, in the headphone 10*a*, the area of the surface of the housing 1000 where the connection portion of the acoustic path 72 and the microphone 100*b* are provided can be made larger than that of the above earphone 60*b* or the like. Thus, a larger distance margin of, for example, several tens millimeters can be provided between the end of the sound collection surface of the microphone 100*b* and the end of the opening of the acoustic path 72 in the surface of the housing 1000 as compared with that in the example of the above earphone 60*b*.

Note that a direction of the connection portion (opening) of the acoustic path 72 and a direction perpendicular to the sound collection surface of the microphone 100*b* are preferably substantially equal to each other in this case as well.

First Modification of the Second Embodiment

Figure 11:
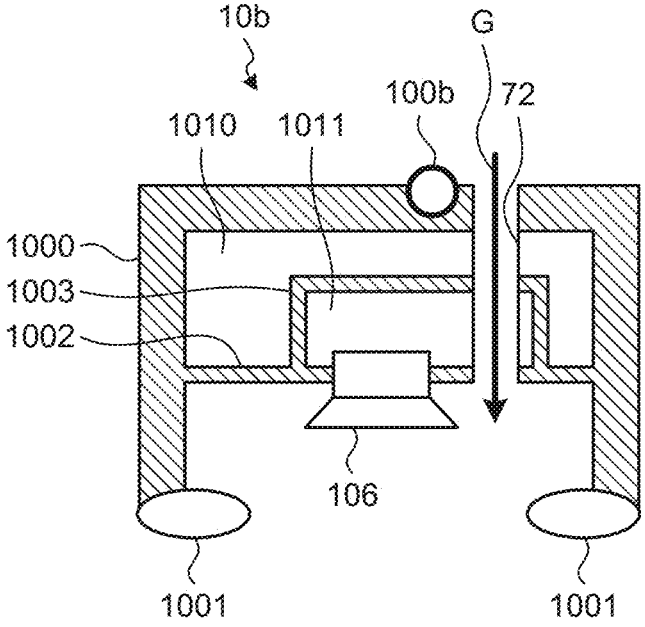
FIG. 11 is a view illustrating a configuration of a headphone example according to a first modification of the second embodiment.

Next, a first modification of the second embodiment will be described. FIG. 11 is a view illustrating a configuration of a headphone example according to the first modification of the second embodiment. In a headphone 10*b* illustrated in FIG. 11, the housing 1000 is divided into the front surface and the back surface of the driver unit 106 by the partition wall 1002, and the second back-surface space 1011 is formed by the partition wall 1003 within the first back-surface space 1010 formed by the housing 1000 and the partition wall 1002 on the back surface of the driver unit 106 in a similar manner to the headphone 10*a* described using FIG. 10.

In the headphone 10*b* according to the first modification of the second embodiment, the front-surface space of the driver unit 106 and the outside of the housing 1000 are connected by the acoustic path 72 that is separated from the second back-surface space 1011 and the first back-surface space 1010.

The microphone 100*b* is disposed in the vicinity of the connection portion (opening) where the acoustic path 72 is connected to the housing 1000 of the headphone 10*b* on the surface of the housing 1000 of the headphone 10*b* in a similar manner to the above second embodiment. The external noise 22 collected by the microphone 100*b* can be thereby collected in a state close to the noise 22 reaching the pinna through the acoustic path 72 (see a path G in FIG. 11). Consequently, the noise cancelling effect according to the FF technique can be further improved.

Second Modification of the Second Embodiment

Figure 12:
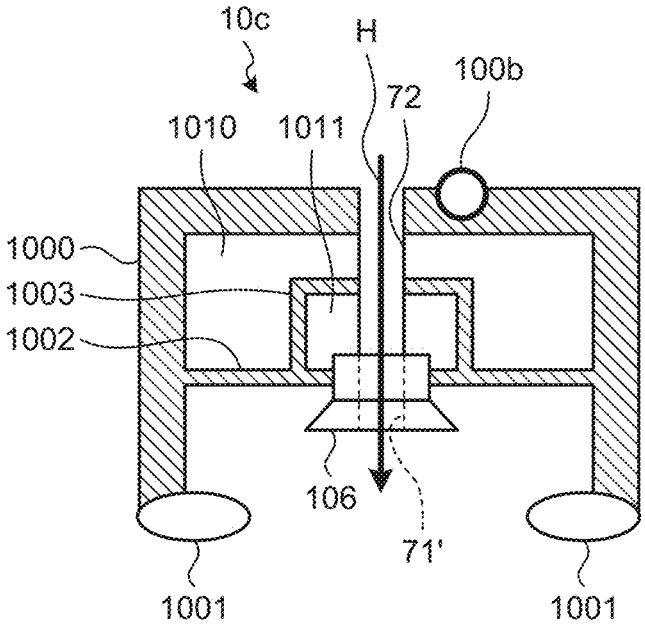
FIG. 12 is a view illustrating a configuration of a headphone example according to a second modification of the second embodiment.

Next, a second modification of the second embodiment will be described. FIG. 12 is a view illustrating a configuration of a headphone example according to the second modification of the second embodiment. A headphone 10*c* illustrated in FIG. 12 corresponds to the earphone 60*c* (see FIG. 7A) according to the above first modification of the first embodiment, and is provided with the vent hole 71 in, for example, the center of the driver unit 106 so as to penetrate the front surface and the back surface of the driver unit 106. The acoustic path 72 is connected to the vent hole 71 or configured including the vent hole 71 to connect the front-surface space of the driver unit 106 and the outside of the housing 1000 of the headphone 10*c* through the second back-surface space 1011 and the first back-surface space 1010.

Since the driver unit 106 has the same structure as that described using FIG. 7B, the detailed description thereof is omitted here.

The microphone 100*b* is disposed in the vicinity of the connection portion (opening) where the acoustic path 72 is connected to the housing 1000 of the headphone 10*b* on the surface of the housing 1000 of the headphone 10*b* in a similar manner to the above second embodiment. The external noise 22 collected by the microphone 100*b* can be thereby collected in a state close to the noise 22 reaching the pinna through the acoustic path 72 (see a path H in FIG. 12). Consequently, the noise cancelling effect according to the FF technique can be further improved.

Third Modification of the Second Embodiment

Figure 13:
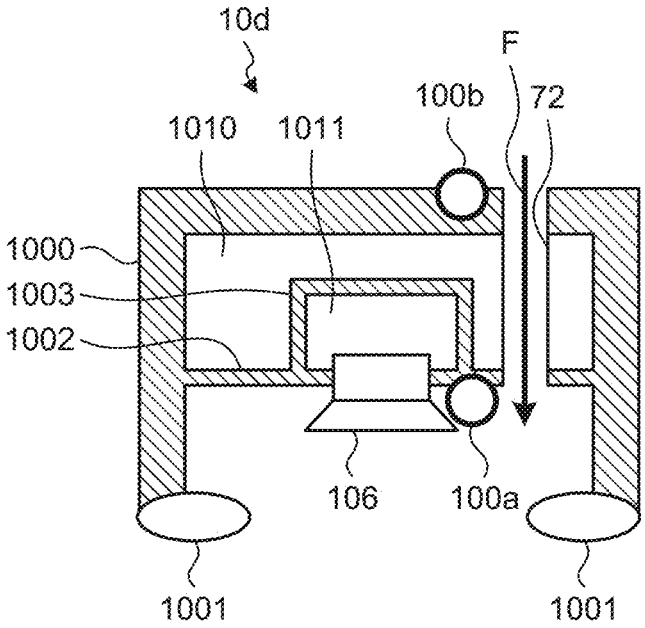
FIG. 13 is a view illustrating a configuration of a headphone example according to a third modification of the second embodiment.

Next, a third modification of the second embodiment will be described. FIG. 13 is a view illustrating a configuration of a headphone example according to the third modification of the second embodiment. A headphone 10*d* according to the third modification of the second embodiment illustrated in FIG. 13 is provided by adding the microphone 100*a* for the FB noise cancelling system to the front-surface space of the driver unit 106 in, for example, the headphone 10*a* according to the second embodiment described using FIG. 10.

In this example, the electrical circuit of the noise cancelling system includes the microphone amplifier, the filter 102*a*, and the equalizer 103 in FIG. 1A, and the microphone amplifier 101 and the filter 102*b* in FIG. 3A in a similar manner to the above second modification of the first embodiment.

The third modification of the second embodiment enables improvement in stability while reducing the gain and decreasing the noise attenuation in the signal processing circuit using the FB technique, and further enables noise removal using the FF technique. As a result, the noise attenuation in the entire system can be increased, and the system can be stably operated.

While it has been described that the microphone 100*a* for the FB noise cancelling system is added to the headphone 10*a* according to the second embodiment, the configuration is not limited to this example. For example, the microphone 100*a* may be also added to the front-surface space of the driver unit 106 in the headphone 10*b* according to the first modification of the second embodiment and the headphone 10*c* according to the second modification of the second embodiment. The same applies to a configuration in FIG. 14 described below.

Fourth Modification of the Second Embodiment

Figure 14:
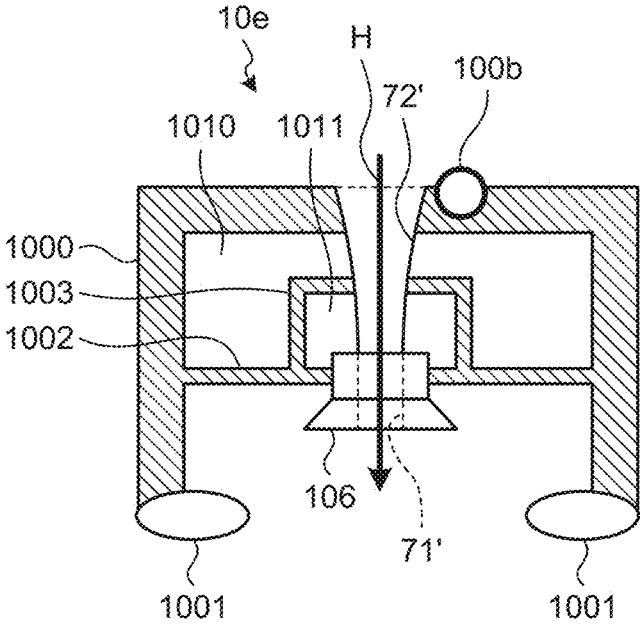
FIG. 14 is a view illustrating a configuration of a headphone example according to a fourth modification of the second embodiment.

Next, a fourth modification of the second embodiment will be described. FIG. 14 is a view illustrating a configuration of a headphone example according to the fourth modification of the second embodiment. Note that FIG. 14 shows an example in which the configuration according to the fourth modification of the second embodiment is applied to the configuration of the headphone 10*c* according to the second modification of the second embodiment described using FIG. 12.

A headphone 10*e* illustrated in FIG. 14 corresponds to the earphone 60*e* (see FIG. 9) according to the above third modification of the first embodiment. An acoustic path 72' that connects the front-surface space of the driver unit 106 and the surface of 1000 of the headphone 10*d* is shaped such that the opening at the connection portion where the acoustic path 72' is connected to the surface of the housing 1000 has a larger area than an opening at a connection portion where the acoustic path 72' is connected to the front-surface space of the driver unit 106.

To be more specific, the acoustic path 72' has a so-called trumpet shape in which its diameter is increased nonlinearly from the driver unit 106 toward the surface of the housing 1000 similarly to the acoustic path 70' in FIG. 9. In other words, a longitudinal cross section of the acoustic path 72' according to the fourth modification of the second embodiment is curved symmetrically to the longitudinal center. The acoustic path 72' is not limited to this shape, and the longitudinal cross section thereof may be also curved asymmetrically to the longitudinal center.

The microphone 100*b* is disposed in the vicinity of the connection portion (opening) where the acoustic path 72' is connected to the surface of the housing 1000 of the headphone 10*e* in a similar manner to the above first embodiment. Configuring the headphone 10*e* as described above also allows the noise reaching the pinna from the outside to be further reduced in the FF noise cancelling system in a similar manner to the above second embodiment.

Additionally, in the fourth modification of the second embodiment, the acoustic path 72' is shaped such that the opening in the surface of the housing 1000 has a larger area than the opening connected to the front-surface space of the driver unit 106 as described above. This makes directivity of the acoustic path 72' against the noise 22 input thereinto close to that of the omni-directional microphone 100*b*. Thus, improvement in the noise reducing effect according to the FF technique can be expected.

Note that the acoustic path 72' according to the fourth modification of the third embodiment can be similarly applied to the headphone 10*a* according to the second embodiment, the headphone 10*b* according to the first modification of the second embodiment, and the headphone 10*d* according to the third modification of the second embodiment described above.

Fifth Modification of the Second Embodiment

Next, a fifth modification of the second embodiment will be described. In the fifth modification of the second embodiment, a position where the microphone 100*b* is disposed will be described using FIGS. 15A to 15C. Here, the headphone 10*c* according to the second modification of the second embodiment described using FIG. 12 will be described as an example.

Figure 15A:
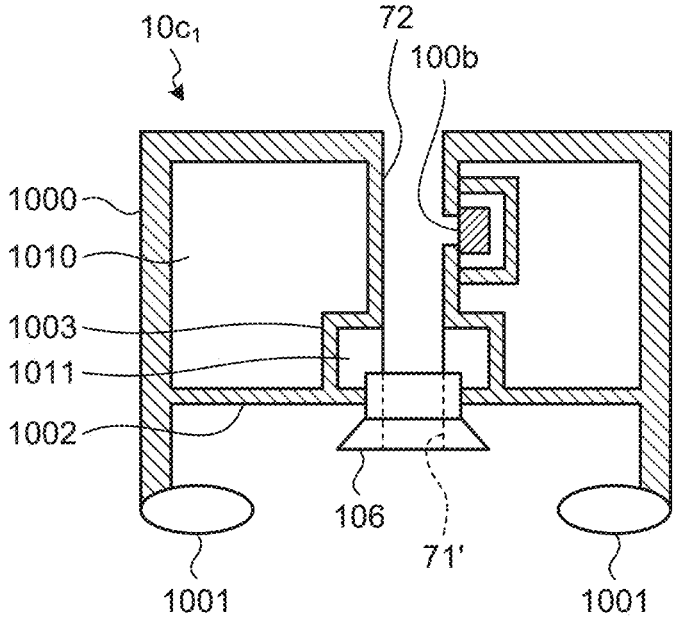
FIG. 15A is a view for explaining a position where a microphone is disposed.

FIG. 15A shows an example in which the microphone 100*b* for noise collection using the FF technique is disposed on an inner surface of the acoustic path 72, more specifically, on an inner wall of the acoustic path 72. In this case, the microphone 100*b* is preferably placed such that the sound collection surface is located in the vicinity of the connection position of the acoustic path 72 with the housing 1000. Additionally, when the microphone 100*b* is disposed on the inner wall of the acoustic path 72, for example, the sound collection surface of the microphone 100*b* is preferably disposed parallel to the inner wall of the acoustic path 72.

Figure 15B:
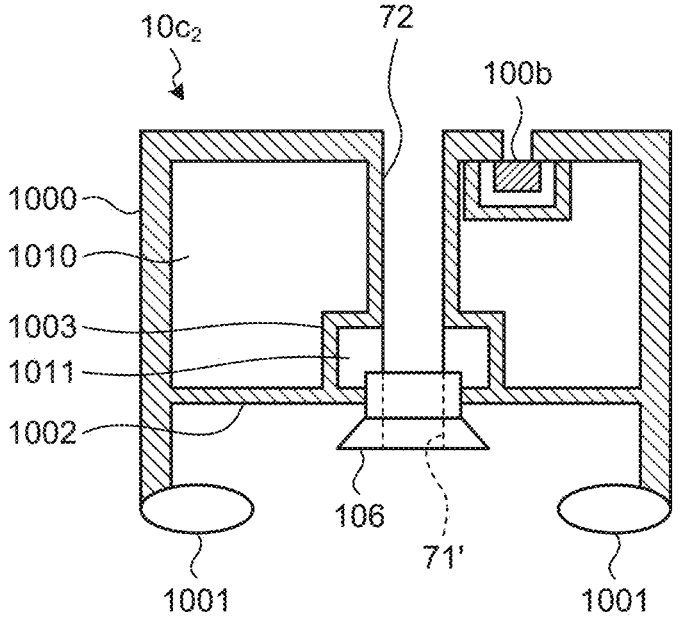
FIG. 15B is a view for explaining another position where the microphone is disposed.

FIG. 15B shows an example in which the microphone 100*b* is arranged flush with the surface of the connection portion (opening) where the acoustic path 72 is connected to the housing 1000 in the housing 1000 of the headphone 10*c*. In other words, the sound collection surface of the microphone 100*b* is placed toward the outside of the housing 1000 in the example of FIG. 15B. The microphone 100*b* is disposed in the vicinity of the connection portion (opening) where the acoustic path 72 is connected to the housing 1000 in the example of FIG. 15B as well. Additionally, the flush surface is, for example, a surface without an edge of a predetermined angle or more with respect to the surface of the connection portion (opening).

Figure 15C:
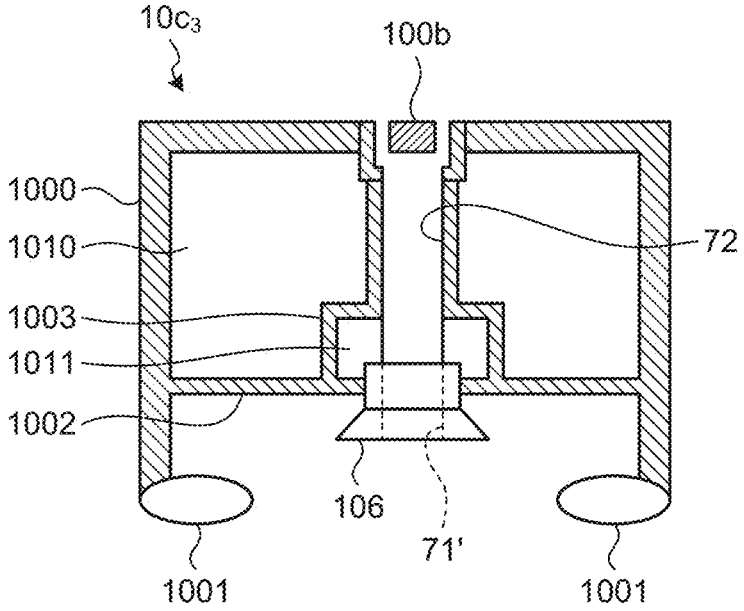
FIG. 15C is a view for explaining another position where the microphone is disposed.

FIG. 15C shows an example in which the microphone 100*b* is placed in the opening at the connection portion where the acoustic path 72 is connected to the housing 1000. In this case, the diameter of the opening is increased according to need such that the microphone 100*b* does not close the acoustic path 72. The arrangement in FIG. 15C is considered to be more advantageous than the arrangement examples in FIGS. 15A and 15B in a sense that the microphone 100*b* is placed in the vicinity of the opening at the connection portion where the acoustic path 72 is connected to the housing 1000.

While the headphone 10*c* has been described as an example, the respective positions of the microphone 100*b* described using FIGS. 15A to 15C can be also applied to the headphones 10*a*, 10*b*, 10*d*, and 10*e* illustrated in FIGS. 10, 11, 13, and 14, respectively.

Moreover, the respective positions of the microphone 100*b* described using FIGS. 15A to 15C can be similarly applied to the earphones 60*b*, 60*c*, 60*d*, and 60*e* illustrated in FIGS. 5A, 7A, 8, and 9, respectively, in the first embodiment and its respective modifications.

The present disclosure can be also configured as follows.

(1) A sound output device comprising:

an acoustic path connecting a first space on a front surface of a driver unit and an outside of a housing including the driver unit separately from a second space on a back surface of the driver unit; and a microphone disposed in the vicinity of an opening where the acoustic path is connected to the outside of the housing.

(2) The sound output device according to the above (1), wherein the acoustic path connects the first space and the outside separately from the second space while penetrating the driver unit and a portion of the second space.

(3) The sound output device according to the above (1), wherein the acoustic path connects the first space and the outside separately from the second space without contacting the driver unit.

(4) The sound output device according to any one of the above (1) to (3), wherein the second space includes a third space connected to the back surface of the driver unit, and the acoustic path connects the first space and the outside separately from the third space and the second space.

(5) The sound output device according to any one of the above (1) to (4), wherein in the acoustic path, an area of an end connected to the outside and an area of an end connected to the first space are substantially equal to each other.

(6) The sound output device according to any one of the above (1) to (4), wherein in the acoustic path, an area of a first end connected to the outside is larger than an area of a second end connected to the first space.

(7) In the sound output device according to the above (6), the acoustic path has a sectional area that increases nonlinearly from the second end toward the first end.

(8) The sound output device according to any one of the above (1) to (7), wherein the microphone is disposed in the vicinity of the opening on a surface of the housing.

(9) The sound output device according to any one of the above (1) to (7), wherein the microphone is disposed on an inner surface of the acoustic path.

(10) The sound output device according to any one of the above (1) to (7), wherein the microphone is disposed in the opening of the acoustic path.

(11) The sound output device according to any one of the above (1) to (10), further comprising a microphone disposed at a position enabling direct collection of sound in the first space.

(12) The sound output device according to any one of the above (1) to (11), wherein the housing is shaped such that the first space is opened in a direction of the front surface of the driver unit.

(13) The sound output device according to any one of the above (1) to (11), wherein the housing is shaped such that an opening having a smaller area than an area of the front surface of the driver unit is disposed in a direction of the front surface of the driver unit in the first space.

(14) In the sound output device according to any one of the above (1) to (13), the microphone is placed at a position where a difference between a characteristic of sound at the opening and a characteristic of sound collected by the microphone is equal to or less than a predetermined value.

REFERENCE SIGNS LIST

10*a*, 10*b*, 10*c*, 10*d*, 10*e*, $\mathbf{10}_{FB}$, $\mathbf{10}_{FF}$ HEADPHONE
20, 20' CONTROL POINT
21 SOUND PRESSURE
22, 23 NOISE
50*a*, 50*b*, 50*c*, 50*e*, 1000 HOUSING
53*a*, 53*b*, 1002, 1003 PARTITION WALL
60*a*, 60*b*, 60*c*, 60*d*, 60*e* EARPHONE
70, 70', 72, 72' ACOUSTIC PATH
101*a*', 101*b*' MICROPHONE/MICROPHONE AMPLIFIER
100*a*, 100*b* MICROPHONE
101 MICROPHONE AMPLIFIER
102*a*, 102*b* FILTER
103 EQUALIZER
105 POWER AMPLIFIER
106 DRIVER UNIT
120, 130, 131 SPATIAL TRANSFER FUNCTION

The invention claimed is:

1. A sound output device comprising:

a housing including an acoustic path connecting a first space on a front surface of a driver unit and an outside of the housing including the driver unit separately from a second space on a back surface of the driver unit; and a microphone disposed in the vicinity of an opening where the acoustic path is connected to the outside of the housing, wherein the microphone is disposed on an inner surface of the acoustic path.

2. The sound output device according to claim 1, wherein the acoustic path connects the first space and the outside separately from the second space while penetrating the driver unit and a portion of the second space.

3. The sound output device according to claim 1, wherein the acoustic path connects the first space and the outside separately from the second space without contacting the driver unit.

4. The sound output device according to claim 1, wherein the second space includes a third space connected to the back surface of the driver unit, and the acoustic path connects the first space and the outside separately from the third space and the second space.

5. The sound output device according to claim 1, wherein in the acoustic path, an area of an end connected to the outside and an area of an end connected to the first space are substantially equal to each other.

6. The sound output device according to claim 1, wherein in the acoustic path, an area of an end connected to the outside is larger than an area of an end connected to the first space.

7. The sound output device according to claim 1, wherein the housing is shaped such that the first space is opened in a direction of the front surface of the driver unit.

8. The sound output device according to claim 1, wherein the housing is shaped such that an opening having a smaller area than an area of the front surface of the driver unit is disposed in a direction of the front surface of the driver unit in the first space.

9. A sound output device comprising:

a housing including an acoustic path connecting a first space on a front surface of a driver unit and an outside of the housing including the driver unit separately from a second space on a back surface of the driver unit; and a microphone disposed in the vicinity of an opening where the acoustic path is connected to the outside of the housing, wherein the microphone is disposed in the opening of the acoustic path.

10. A sound output device comprising:

a housing including an acoustic path connecting a first space on a front surface of a driver unit and an outside of the housing including the driver unit separately from a second space on a back surface of the driver unit; and a microphone disposed in the vicinity of an opening where the acoustic path is connected to the outside of the housing, further comprising a microphone disposed at a position enabling direct collection of sound in the first space.

* * * * *